US006338426B1

(12) United States Patent
Okiyama

(10) Patent No.: US 6,338,426 B1
(45) Date of Patent: Jan. 15, 2002

(54) GARMENT HANGER

(76) Inventor: Hidekazu Okiyama, 1-33-1-604, Yazaki-cho, Fuchu-shi, Tokyo (JP)

( * ) Notice: Subject to any disclaimer, the term of this patent is extended or adjusted under 35 U.S.C. 154(b) by 0 days.

(21) Appl. No.: 09/609,271

(22) Filed: Jun. 30, 2000

(51) Int. Cl.[7] ..... A47G 25/30
(52) U.S. Cl. ..... 223/96; 223/93
(58) Field of Search ..... 223/96, 91, 93, 223/85, 88, 92, 95

(56) References Cited

U.S. PATENT DOCUMENTS

| | | | | |
|---|---|---|---|---|
| 625,137 A | | 5/1899 | Bowman | |
| 717,147 A | | 12/1902 | Walter | |
| 866,754 A | | 9/1907 | Wedmore | |
| 1,017,854 A | | 2/1912 | Corbin | |
| 1,605,918 A | * | 11/1926 | Buchanan | 223/88 |
| 1,689,126 A | | 10/1928 | Gass | |
| 1,770,159 A | | 7/1930 | Johnson | |
| 2,107,026 A | | 2/1938 | Coney | |
| 2,129,455 A | * | 9/1938 | Wisehart et al. | 223/88 |
| 2,205,489 A | | 6/1940 | Nelson | |
| 2,413,221 A | | 12/1946 | Elston | |
| 2,426,556 A | | 8/1947 | Kohl | |
| 2,458,997 A | | 1/1949 | Levine | |
| 3,054,538 A | | 9/1962 | Rubin et al. | |

FOREIGN PATENT DOCUMENTS

| | | |
|---|---|---|
| JP | 3065446 | 2/2000 |

* cited by examiner

*Primary Examiner*—Bibhu Mohanty

(57) ABSTRACT

A garment hanger includes a hook having a base, first and second hanger arms extending from the base of the hook in opposite directions and angled downwardly relative to the hook; and an elongated horizontal support rod coupled at each end to substantially S-shaped retaining portions. The retaining portions are positioned directly under the support rod and adapted to suspend and securely retain a garment between the support rod and the retaining portions in a fixed position and prevent or minimize the occurrence of creases in the garment. The first and second hanger arms, support rod, and first and second retaining portions are aligned vertically with one another on a single vertical plane and integrally formed of a rod like member with substantially the same size and shape in cross section throughout. The garment hanger is sturdy and is adapted to hold and retain numerous types of garments, as well as retain several garments at the same time, such as a jacket and pants.

12 Claims, 3 Drawing Sheets

GARMENT HANGER

CLAIM OF FOREIGN PRIORITY UNDER 35 U.S.C. SECTION 119

This patent application claims priority under 35 U.S.C. Section 119 to Japanese Utility Model Application Number 3065446, filed Jul. 2, 1999, which is incorporated herein by reference in its entirety.

BACKGROUND OF THE INVENTION

The present invention is directed to a clothes or garment hanger. More particularly, the present invention is directed to a unique clothes or garment hanger having a support rod coupled to substantially S-shaped retaining portions that are adapted to retain a garment in a fixed position and prevent or minimize the occurrence of creases in the garment.

Garment hangers are important for use in the clothes cleaning, dry cleaning, tailoring, and garment industries. Concerns among those in the clothes cleaning, dry cleaning, tailoring, and garment industries are that the garments or clothing that hang on the garment hangers do not get wrinkled, creased, or damaged and that the garments are secured on the garment hangers and do not easily slide or fall off the hangers.

Garment hangers typically comprise a hook portion adapted to suspend the hanger from a closet rod or support bar, a pair of angled arms extending in opposite directions from the hook portion and adapted to receive the shoulders of a garment such as a jacket or shirt, and a support bar or rod connecting the angled arms and adapted to support or retain a garment such as pants or trousers.

A known garment hanger is disclosed in U.S. Pat. No. 2,107,026. This patent discloses a garment hanger having a retaining clamp. However, a problem with the design of the garment hanger in this patent is that the end of the retaining clamp is exposed and curved upwardly which can create problems with catching on the garment and damaging the garment.

Another known garment hanger is disclosed in U.S. Pat. No. 1,689,126. This patent discloses a garment hanger having a cross bar with inwardly and upwardly inclined hooks. However, a problem with the design of the garment hanger in this patent is that the hanger is not suitable for retaining pants without belt loops or skirts without hanging loops. In addition, the hanger in this patent is not designed to hold both pants and a jacket.

Another known garment hanger is disclosed in U.S. Pat. No. 1,017,854. This patent discloses a garment hanger having a support bar with clamps. However, a problem with the design of the garment hanger in this patent is that the hanger requires the addition of separately formed clamps to retain skirts or pants. Thus, the manufacturing costs are increased over designs that do not require such clamps. In addition, the clamps can damage clothes by causing creases or indentations in the garments at the point that the clamp holds the garment.

Accordingly, there is a need for a new and improved garment hanger which overcomes and avoids the problems associated with known garment hangers. None of these or other known garment hangers provide all of the advantages of the present invention. Additionally, known garment hangers do not suggest or provide the present novel combination of components as disclosed and claimed herein.

SUMMARY OF THE INVENTION

The present invention satisfies these needs as well as provides a unique and nonobvious garment hanger. The advantages of the present invention over known garment hangers include, but are not limited to, the following: providing a garment hanger made of a friction-free material and having a support rod coupled to substantially S-shaped retaining portions that are adapted to securely retain a garment in a fixed position and prevent or minimize the occurrence of creases in the garment; providing a garment hanger that is sturdy and can easily hold all types of garments with or without loops, i.e., belt loops, as well as hold both a jacket and pants and provides easy removal of the pants without having to remove the jacket from the hanger; providing a garment hanger that does not require additional clips, clamps, or pins to retain garments, and thus avoiding damage to garments caused by the use of such additional devices; providing a garment hanger in which the retaining portions do not have exposed ends, thus avoiding damage to the garment; providing a unitary garment hanger that may be formed of a single wire, thus decreasing the costs of manufacturing and decreasing the complexity of the manufacturing; providing a garment hanger that may be formed of a single wire and a rolled paper support tube wherein the rolled paper support tube has a substantially friction-free, nonadhesive surface, thus avoiding the damage to garments caused by known rolled paper support tubes having adhesive surfaces; and providing a garment hanger that is easy and inexpensive to fabricate and manufacture and is not prone to damage in handling or use.

The present invention is directed to a garment hanger comprising: (a) a hook having a base; (b) first and second hanger arms extending from the base of the hook in opposite directions and angled downwardly relative to the hook; (c) an elongated horizontal support rod disposed between the first and second hanger arms, the support rod having a first end coupled to a substantially S-shaped first retaining portion, the first retaining portion continuous with the first hanger arm, and the support rod further having a second end coupled to a substantially S-shaped second retaining portion, the second retaining portion continuous with the second hanger arm. The first and second retaining portions are the same shape and configuration, are mirror images of each other, are spaced apart and opposite from each other, and are disposed between the hanger arms. The first and second retaining portions are adapted to suspend and retain a garment between the support rod and the retaining portions at several points of retention.

The hanger arms are adapted to support a different opposed shoulder of a first garment. The first and second retaining portions are adapted to retain a second garment between the support rod and the first and second retaining portions and preferably within the first garment and vertically below the first garment.

In one version of the present invention the hook, hanger arms, support rod, and retaining portions of the garment hanger are formed in one continuous unitary piece, preferably a preformed metal wire.

In another version of the present invention the hook, hanger arms, and retaining portions are formed in one continuous unitary piece, preferably a preformed metal wire, and the support rod is a second piece which is coupled to each of the retaining portions between the hanger arms. Preferably, the support rod in this version is a hollow tube comprised of rolled paper and having a substantially friction-free surface.

BRIEF DESCRIPTION OF THE DRAWINGS

These and other features, aspects and advantages of the present invention will become better understood from the following description, appended claims, and accompanying drawings, where:

DETAILED DESCRIPTION

The present invention is directed to a garment or clothing hanger having a combination of unique features.

Figure 2:
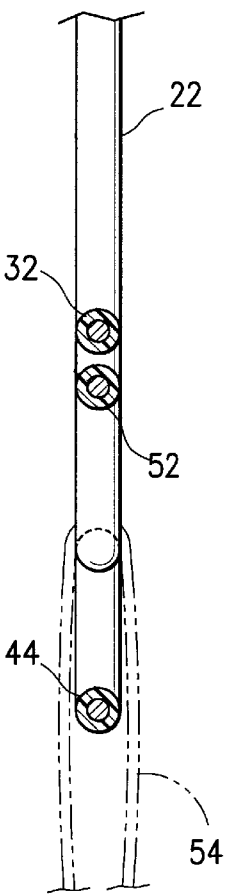
FIG. 2 a cross-sectional view of the first version of the garment hanger in the direction of line 2—2 of FIG. 1.
Figure 1:
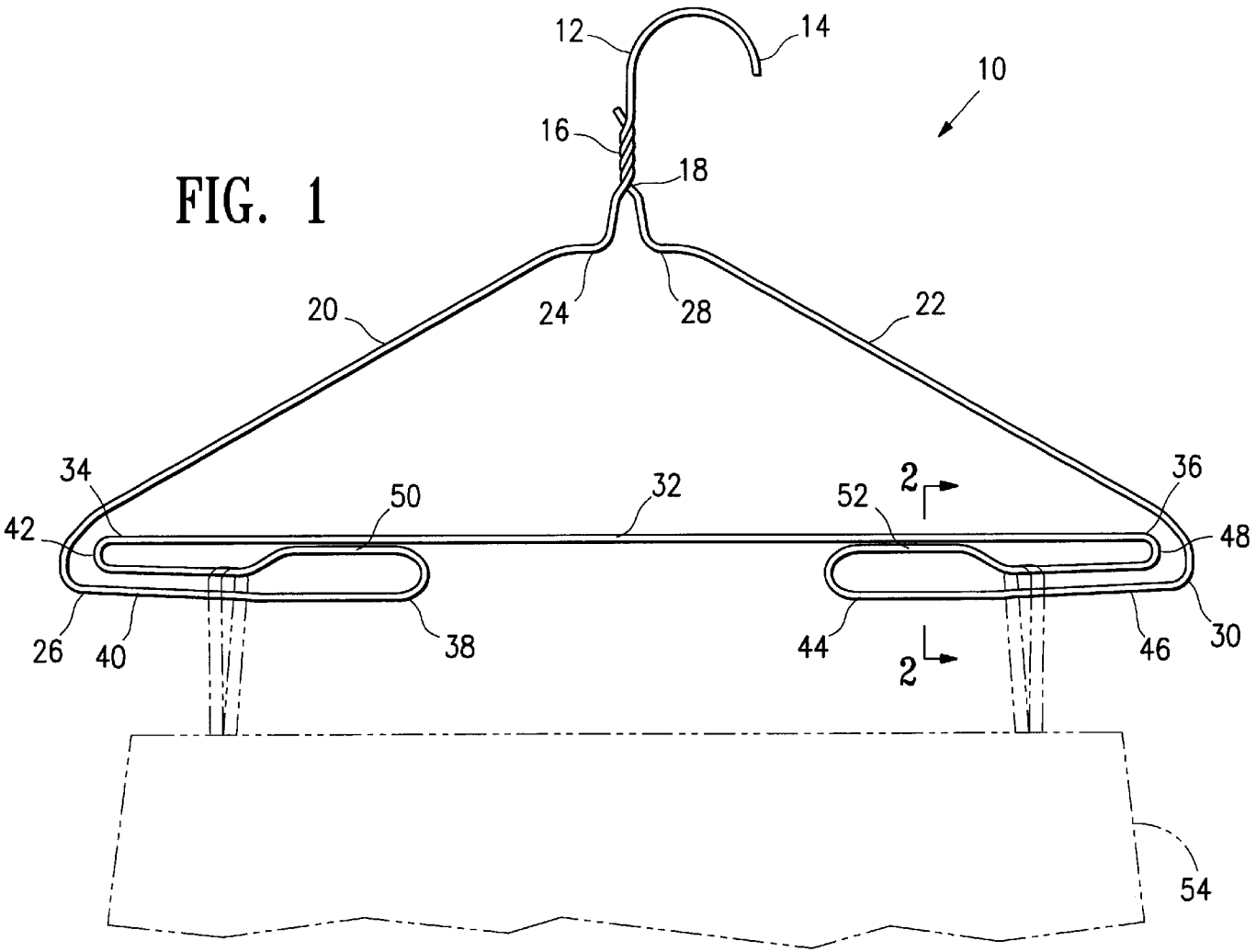
FIG. 1 is a perspective view of a first version of the garment hanger of the present invention showing one version of how a garment can be retained on the hanger.

FIG. 1 shows a perspective view of a first version of the garment hanger of the present invention showing one version of how a garment, such as a skirt with hanging loops, can be retained on the hanger. FIG. 2 shows a cross-sectional view of the first version of the garment hanger in the direction of line 2—2 of FIG. 1. The garment hanger 10 of the present invention comprises a hook 12. The hook 12 has a curved portion 14, a stem 16, and a base 18. The hook 12 is of a suitable configuration to suspend the garment hanger 10 from a tubular closet rod or support bar. The hanger 10 further comprises a first hanger arm 20 and a second hanger arm 22. Preferably, each hanger arm 20, 22 is equal in length, and preferably each has a length of between 9 inches to 10 inches. The first hanger arm 20 has a top end 24 and a bottom end 26. The second hanger arm 22 has a top end 28 and a bottom end 30. The top ends 24, 28, of hanger arms 20, 22, respectively, extend from the base 18 of the hook 12 in opposite directions and are angled downwardly relative to the hook 12. The hanger arms 20, 22 are of a suitable configuration so as to receive the shoulders of a garment, such as a jacket or shirt, for hanging.

The garment hanger 10 further comprises an elongated horizontal support rod 32 disposed within and between the first and second hanger arms 20, 22 and is preferably in planar alignment with the first and second hanger arms 20, 22. Preferably, the support rod 32 has a substantially friction-free surface so that garments that are hung over the rod do not become damaged or caught on the rod. Preferably, the support rod 32 has a length of between 14 inches to 16 inches. The support rod 32 has a first end 34 and a second end 36. The first end 34 of the support rod 32 is coupled to a substantially S-shaped first retaining portion 38. The first retaining portion 38 has a first end 40 and a second end 42. The first end 40 of the first retaining portion 38 is continuous with the first hanger arm 20. The second end 36 of the support rod 32 is coupled to a substantially S-shaped second retaining portion 44. The second retaining portion 44 has a first end 46 and a second end 48. The first end 46 of the second retaining portion 44 is continuous with the second hanger arm 22. Preferably, the first and second retaining portions 38,44 are equal in length, and preferably each has a length of between 4 inches to 5 inches. The garment hanger 10 is preferably manufactured so that the support rod 32 is in parallel alignment with the first and second retaining portions 38, 44. With no garment on the hanger of the present invention, the support rod 32 is preferably adjacent to the first retaining portion 38 at region 50 and is preferably adjacent to the second retaining portion 44 at region 52. These regions 50, 52 or points of retention are the areas for securing or retaining a garment in a fixed position when the garment, such as a pair of pants, is folded over the support rod 32 and held behind the first and second retaining portions 38, 44. The garment hanger of the present invention is preferably made of a suitably flexible and pliable material such that when a garment is retained between the support rod 32 and the first and second retaining portions 38, 44, regions 50, 52 are spaced apart from the support rod 32 to accommodate the cloth of the garment such as pants, trousers, or a skirt. In addition, it is not necessary that the support rod 32 itself have an adhesive or friction surface because the retaining portions 38, 44 act to retain the garment on the support rod 32. Preferably, when a garment, such as pants or trousers, is hung from the garment hanger, the pants are folded over the support rod 32 and portions of the pants are positioned behind the retaining portions 38, 44, so as to securely retain the pants in a fixed position and minimize or avoid creases in the pants.

Figure 4:
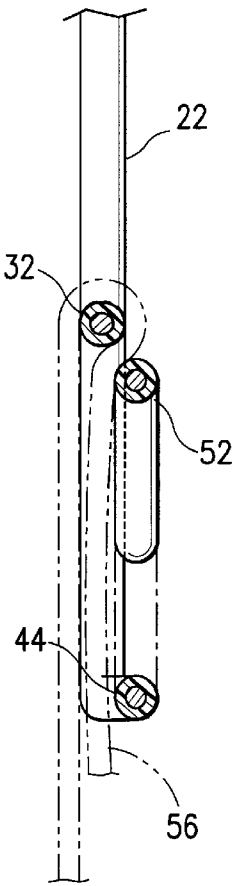
FIG. 4 a cross-sectional view of the first version of the garment hanger in the direction of line 4—4 of FIG. 3.
Figure 3:
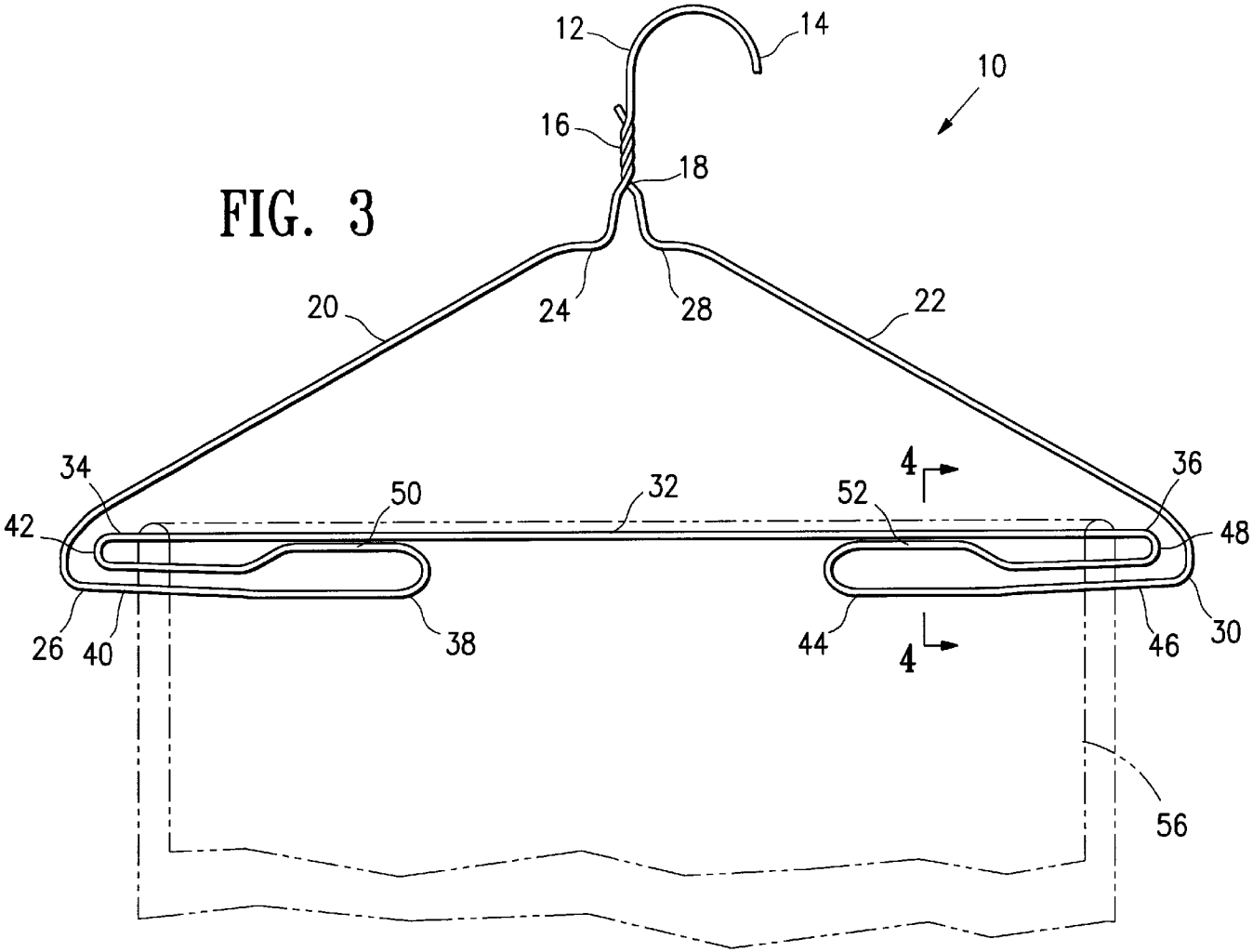
FIG. 3 is a perspective view of a first version of the garment hanger of the present invention showing a second version of how a garment can be retained on the hanger.

FIG. 3 is a perspective view of a first version of the garment hanger of the present invention showing a second version of how a garment, such as pants, can be retained on the hanger. FIG. 4 a cross-sectional view of the first version of the garment hanger in the direction of line 4—4 of FIG. 3, showing how the pants are folded over the support rod and a portion of the pants are positioned behind the first and second retaining portions 38, 44 so as to retain the garment securely in place and minimize or avoid creases in the garment. More particularly, as shown in FIG. 4, a first curve of the garment is created on an upper surface of the support rod 32 because the garment is folded over the support rod 32, and a second curve is created on upper surfaces of the first and second retaining portions 38 and 44 at a lower surface of the support rod 32. Because of the first and second curves of the garment, the garment hanger of the present invention can securely retain the garment without allowing the garment from sliding or falling off from the hanger.

The first and second retaining portions 38, 44 are preferably the same shape and configuration, are mirror images of each other, are spaced apart and opposite from each other, and are disposed between and within the hanger arms 20, 22. Each of the first and second retaining portions 38, 44 is adapted to suspend and retain a garment 54 (FIG. 1) or garment 56 (FIG. 3) between the support rod 32 and the retaining portions at the points of retention 50, 52. The first and second retaining portions 38,44 are preferably spaced apart from each other at a distance of less than the width of a garment retained thereon. Preferably, the first and second retaining portions 38, 44 are spaced an equidistance from an imaginary vertical longitudinal central axis (not shown) running down the center of the hanger from the hook through the support rod.

The hanger arms 20, 22 are adapted to support a different opposed shoulder of a first garment (not shown). As shown in FIG. 1, the first and second retaining portions 38, 44 are adapted to retain a second garment 54 between the support rod 32 and the first and second retaining portions 38, 44. Preferably, the second garment, such as a pair of pants, is retained within the first garment, such as a jacket, and hangs vertically below the first garment.

In the version of the present invention as shown in FIG. 1, the hook 12, hanger arms, 20, 22, support rod 32, and retaining portions 38, 44 of garment hanger 10 are formed in one continuous unitary piece. The garment hanger 10 is preferably comprised of a metal such as steel. Preferably, the hanger 10 is comprised of a preformed metal wire before being formed into the garment hanger. Preferably, the length of the preformed metal wire used for the garment hanger of the present invention is between 3 feet and 4 feet long. However, other suitable lengths may be used. Preferably, the material is available from most hardware stores. The material used to make present invention was obtained in Tokyo, Japan. The material used with the present invention provides advantages such as low manufacturing costs and simple fabrication, and has a desirable flexibility and durability. The thickness or diameter of the metal wire used to make the hanger of the present invention is preferably between about 2 mm to about 3 mm. However, other suitable thicknesses may be used. The metal wire may be coated with a polymeric material, a polyester material, a paint, or other suitable material to provide a substantially friction-free surface. Because the support rod does not need an adhesive surface to retain a garment, damage to a garment caused by the use of adhesive is avoided. The garment hanger may also be made of other suitable materials such as molded plastic.

Figure 6:
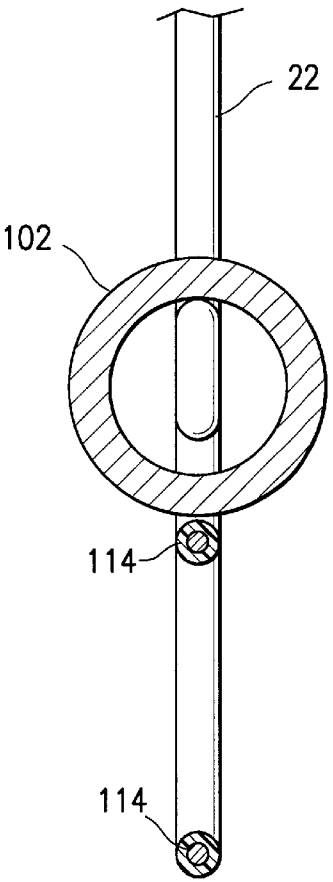
Figure 5:
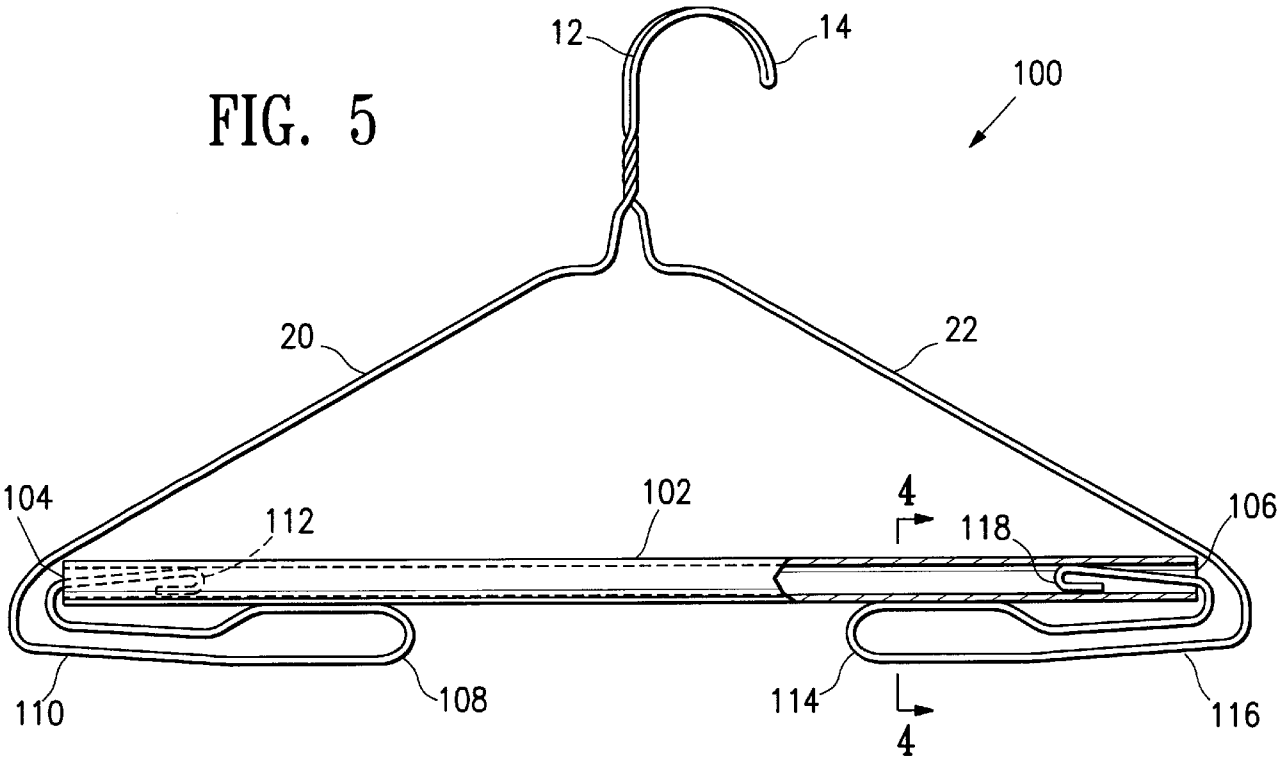
FIG. 5 is a perspective view of a second version of the garment hanger of the present invention; and, FIG. 6 a cross-sectional view of the second version of the garment hanger in the direction of line 6—6 of FIG. 5.

FIG. 5 shows a perspective view of a second version of the garment hanger of the present invention. FIG. 6 shows a cross-sectional view of the second version of the garment hanger in the direction of line 6—6 of FIG. 5. In this version of the present invention, the hook, hanger arms, and retaining portions are formed in one continuous unitary piece and the support rod is a second piece which is coupled to each of the retaining portions between the hanger arms. FIG. 5 shows a garment hanger 100 comprising a hook 12 having a base 18, and first and second hanger arms 20, 22 extending from the base 18 of the hook 12 in opposite directions and angled downwardly relative to the hook 12. Garment hanger 100 comprises a support rod 102 in the form of a separate and removable hollow tube 102. The hollow tube 102 has a first end 104 and a second end 106. Preferably, the hollow tube 102 is comprised of rolled paper having a substantially friction-free surface. However, the hollow tube may also be made of other suitable materials. Preferably, the hollow tube 102 is a separate and removable piece from the garment hanger. Preferably, the hollow tube 102 has a length of between 13 inches to 14 inches.

The garment hanger 100 further comprises a first retaining portion 108 having a first end 110 and a second end 112. The garment hanger 100 further comprises a second retaining portion 114 having a first end 116 and a second end 118. The first end 104 of the hollow tube 102 is coupled to the second end 112 of the first retaining portion 108, such that the second end 112 of the first retaining portion 108 is inserted into the first end 104 of the hollow tube 102 and securely retained within the hollow tube 102. The second end 106 of the hollow tube 102 is coupled to a second end 118 of the second retaining portion 114, such that the second end 118 of the second retaining portion 114 is inserted into the second end 106 of the hollow tube 102 and securely retained within the hollow tube 102. Preferably, between about 0.5 inches to 2 inches of each of the ends of the first and second retaining members 108, 114 are inserted into the hollow tube 102 When the hollow tube 102 is securely in place, the hollow-tube 102 is disposed between the first and second hanger arms 20, 22.

The first and second retaining portions 108, 114 are preferably substantially S-shaped in configuration, are mirror images of each other, are spaced apart and opposite from each other, and are disposed between the first and second hanger arms 20, 22. Each of the first and second retaining portions 108, 114 are adapted to suspend and retain a garment between the hollow tube 102 and the retaining portions 108, 114 at regions or points of retention 50, 52.

The garment hanger of this version is also adapted to retain a first garment on the hanger arms and a second garment between the hollow tube and the first and second retaining portions. Preferably, when a garment, such as pants or trousers, is hung from the garment hanger, the pants are folded over the hollow tube 102 and portions of the pants are positioned behind the retaining portions 108, 114, so as to securely retain the pants in a fixed position and minimize or avoid creases in the pants.

Although the present invention has been described in considerable detail with reference to certain preferred versions thereof, other versions of the invention are possible. Therefore, the scope of the appended claims should not be limited to the description of the preferred versions contained herein.

What is claimed is:

1. A garment hanger comprising:

(a) a hook having a base;

(b) first and second hanger arms extending from the base of the hook in opposite directions and angled downwardly relative to the hook;

(c) an elongated horizontal support rod disposed between the first and second hanger arms, the support rod having a first end coupled to a substantially S-shaped first retaining portion, the first retaining portion being continuous with the first hanger arm and positioned directly below the support rod, and the support rod further having a second end coupled to a substantially S-shaped second retaining portion, the second retaining portion being continuous with the second hanger arm and positioned directly below the support rod, wherein the first and second retaining portions are the same shape and configuration with one another and are endlessly shaped without any end terminal, and are spaced apart and opposite from each other, and wherein each of the first and second retaining portions is adapted to suspend and retain a garment between the support rod and the retaining portions in such a way that a first curve of the garment is formed around an upper surface of the support rod and a second curve of the garment is formed between a lower surface of the support rod and upper surfaces of the first and second retaining portions, and further wherein the first and second hanger arms, support rod, and first and second retaining portions are aligned vertically with one another on a single vertical plane and integrally formed of a rod like member with substantially the same size and shape in cross section throughout.

2. The garment hanger of claim 1 wherein the hanger arms are adapted to support a different opposed shoulder of a first garment, and the first and second retaining portions are adapted to retain a second garment between the support rod and the first and second retaining portions and within the first garment and vertically below the first garment in such a way that a first curve of the second garment is formed on and around the upper surface of the support rod and a second curve of the second garment is formed between on and around the lower surface of the support rod and the upper surfaces of the first and second retaining portions.

3. The garment hanger of claim 1 wherein the support rod is in parallel alignment with and adjacent to a region of each of the first and second retaining portions.

4. The garment hanger of claim 1 wherein the first and second retaining portions are spaced an equidistance apart from a vertical longitudinal central axis through the center of the hanger.

5. The garment hanger of claim 1 wherein the hook, hanger arms, support rod, and retaining portions are formed in one continuous unitary piece.

6. The garment hanger of claim 1 wherein the support rod has a substantially friction-free surface.

7. The garment hanger of claim 1 wherein the garment hanger is comprised of metal.

8. The garment hanger of claim 7 wherein the metal is steel.

9. The garment hanger of claim 7 wherein the metal is a preformed wire.

10. The garment hanger of claim 9 wherein the metal wire is coated with a coating selected from the group consisting of a polymeric material, a polyester material, or a paint.

11. The garment hanger of claim 1 wherein the garment hanger is comprised of molded plastic.

12. A unitary garment hanger formed from a preformed metal wire comprising:

(a) a hook having a base;

(b) first and second hanger arms extending from the base of the hook in opposite directions and angled downwardly relative to the hook, the hanger arms adapted to support a different opposed shoulder of a first garment;

(c) an elongated horizontal support rod disposed between the first and second hanger arms, the support rod having a first end forming a substantially S-shaped first retaining portion, the first retaining portion being continuous with the first hanger arm and positioned directly below the support rod, and the support rod further having a second end forming a substantially S-shaped second retaining portion, the second retaining portion being continuous with the second hanger arm and positioned directly below the support rod;

wherein the first and second retaining portions are the same shape and configuration with one another and are endlessly shaped without any end terminals, and are spaced apart and opposite from each other, and wherein the first and second hanger arms, support rod, and first and second retaining portions are aligned in a vertical relationship with one another on a vertical plane and integrally formed of a rod like member with substantially the same size and shape in cross section throughout, and further wherein the first and second retaining portions are adapted to suspend and retain a second garment between the support rod and the first and second retaining portions and within the first garment and vertically below the first garment in such a way that a first curve of the second garment is formed on an upper surface of the support rod and a second curve of the second garment is formed between a lower surface of the support rod and upper surfaces of the first and second retaining portions.

* * * * *